US008784110B2

(12) United States Patent
Hug et al.

(10) Patent No.: US 8,784,110 B2
(45) Date of Patent: Jul. 22, 2014

(54) URINE STREAM TARGET DEVICE, TOILET TRAINING METHOD, AND METHOD OF MANUFACTURE

(71) Applicants: Kathryn R. Hug, Wheaton, IL (US); Thomas W. Marrero, Riverside, IL (US)

(72) Inventors: Kathryn R. Hug, Wheaton, IL (US); Thomas W. Marrero, Riverside, IL (US)

( * ) Notice: Subject to any disclaimer, the term of this patent is extended or adjusted under 35 U.S.C. 154(b) by 79 days.

(21) Appl. No.: 13/677,582

(22) Filed: Nov. 15, 2012

(65) Prior Publication Data

US 2014/0134583 A1 May 15, 2014

(51) Int. Cl.
*G09B 19/00* (2006.01)
*E03D 9/00* (2006.01)

(52) U.S. Cl.
CPC ..... *E03D 9/00* (2013.01)
USPC ..... 434/247

(58) Field of Classification Search
CPC ..... G09B 19/00; G09B 19/0076
USPC ..... 434/236, 247, 258, 260; 4/300.3, 661; D23/310
See application file for complete search history.

(56) References Cited

U.S. PATENT DOCUMENTS

| | | | | |
|---|---|---|---|---|
| 2,703,407 | A | 3/1955 | Henoch et al. | |
| 2,931,047 | A | 4/1960 | Stebbins | |
| 3,212,104 | A | 10/1965 | Stevens | |
| 4,044,405 | A | 8/1977 | Kreiss | |
| D258,181 | S | 2/1981 | Adam | |
| D258,472 | S | 3/1981 | Adam | |
| 5,031,253 | A | 7/1991 | Brendlinger | |
| 5,044,020 | A | 9/1991 | Lewandowski et al. | |
| 5,117,512 | A | 6/1992 | Bressler | |
| 5,117,515 | A * | 6/1992 | White et al. | 4/661 |
| 5,809,590 | A | 9/1998 | Williams et al. | |
| 6,183,850 | B1 * | 2/2001 | Lauer | 428/304.4 |
| 6,416,853 | B1 * | 7/2002 | Nakashima et al. | 428/313.9 |
| D481,448 | S | 10/2003 | Argentina | |
| 6,648,650 | B1 * | 11/2003 | Fiorella | 434/247 |
| 6,772,454 | B1 | 8/2004 | Barry et al. | |
| 6,811,403 | B1 | 11/2004 | Camarena | |
| 6,908,392 | B2 | 6/2005 | Friedman et al. | |
| 7,017,198 | B2 | 3/2006 | Conn et al. | |
| 7,373,673 | B1 | 5/2008 | Holland | |
| 7,798,907 | B2 * | 9/2010 | Piccionelli et al. | 463/49 |
| 8,038,446 | B2 * | 10/2011 | Cohen et al. | 434/258 |
| 8,112,828 | B1 | 2/2012 | Varella, III | |
| 2006/0179563 | A1 | 8/2006 | Kneese et al. | |
| 2006/0260497 | A1 | 11/2006 | Neale et al. | |
| 2009/0070921 | A1 | 3/2009 | Young | |
| 2010/0003655 | A1 | 1/2010 | Stephenson, Jr. | |

* cited by examiner

*Primary Examiner* — Kurt Fernstrom
(74) *Attorney, Agent, or Firm* — Meroni & Meroni, P.C.; Charles F. Meroni, Jr.; Christopher J. Scott

(57) ABSTRACT

A multilayer urine stream target device usable as a toilet training aid includes an upper layer of a first relatively absorbent material, a lower layer of a second relatively non-absorbent material adhesively attached to the upper layer. The upper or first layer of material comprises an alkaline environment and a pH indicator. The pH indicator provides the upper or first layer with first coloration. The upper layer is floatable upon a water surface as typified within a toilet bowl by way of the relatively non-absorbent lower or second layer of material. When a urine stream makes contact with the upper or first layer, the pH-indicator causes a color change in the first material, which color change is believed to promote the targeting of the target device by a urine stream provider.

19 Claims, 8 Drawing Sheets

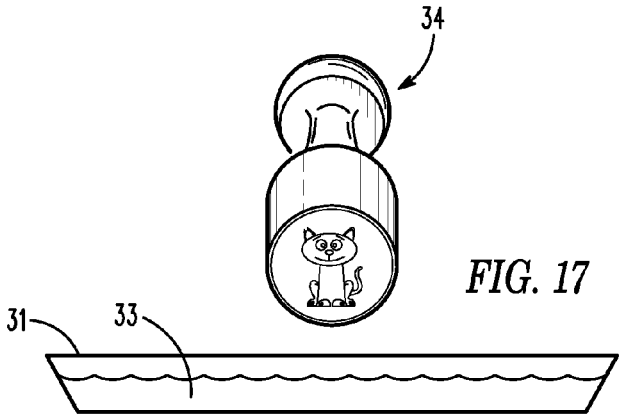
FIG. 17
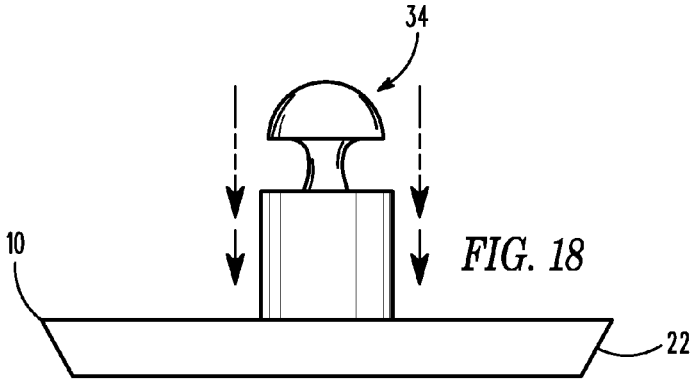
FIG. 18
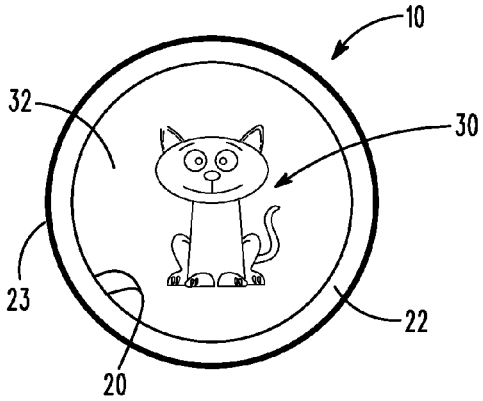
FIG. 19
FIG. 20
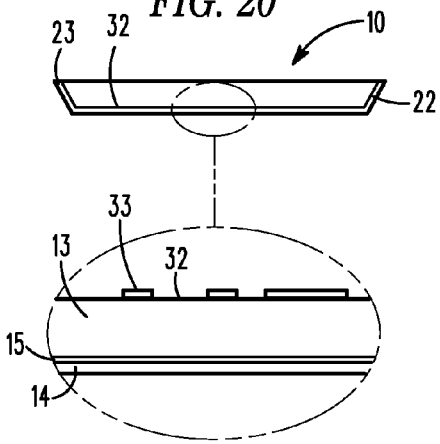
FIG. 20 (a)

URINE STREAM TARGET DEVICE, TOILET TRAINING METHOD, AND METHOD OF MANUFACTURE

BACKGROUND OF THE INVENTION

1. Field of the Invention

The present invention relates generally to a floatable urine stream target device for buoyant placement upon the upper water surface within a toilet bowl. More particularly, the present invention relates to a urine stream target device positionable within a urine-receiving receptacle for the purpose of toilet training youngsters by way of effecting color changes upon the target device when struck with a urine stream.

2. Brief Description of the Prior Art

Devices used in combination with urine stream receiving receptacles for the purpose of aiding youngsters during the toilet training process are somewhat well known in the art. A description of some of the more pertinent toilet training aids having urine-stream targeting as a feature thereof are briefly described hereinafter.

U.S. Pat. No. 2,703,407 ('407 patent), which issued to Henoch et al., for example, discloses a Boy's Toilet Trainer. The '407 patent describes a boy's toilet trainer for the purpose of training young male children to urinate into a toilet bowl comprising a rotatable member activated by the stream of fluid so positioned that it will discharge into the bowl, a support for said rotatable member activated by the stream of fluid so positioned that it will discharge into the bowl, a support for said rotatable member mounted on the side of the bowl and a connection enabling the device to be swung into and out of position above the toilet bowl.

U.S. Pat. No. 4,044,405 ('405 patent), which issued to Kreiss, discloses a Target in a Bowl or Urinal to Attract the Attention of Urinating Human Males. The '405 patent describes a target means wholly disposed within a toilet bowl or urinal. The target means are flexible prior to being non-removably connected and are disposed in the bowl or urinal such that no part of the target means extends outside of the volume partially enclosed by the bowl or urinal, the target means being devoid of any moving parts.

U.S. Pat. No. 5,031,253 ('253 patent), which issued to Brendlinger, discloses a Method of Making a Sanitary Toilet Anti-Splash and Silencer Device and Article Produced Thereby. The '253 patent describes a floatable member formed from two or more layers or sheets of biodegradable paper. The layers are joined together by an adhesive pattern which establishes individual compartments between the layers. A gas forming agent is placed in at least a plurality of the compartments. The gas forming agent releases a gas such as $CO_2$ when exposed to water thereby providing buoyancy when the device is placed on the water in a toilet. The device may have a target indicia imprinted thereon and it may be provided with a paper strip or string so that the device may be positioned or held in place in the toilet.

U.S. Pat. No. 5,117,512 ('512 patent), which issued to Bressler, discloses a Urine Shield for Toilets. The '512 patent describes a urine shield for toilets having a bowl and a rim includes an elongated normally flat body of general rectangular shape and of a resilient material, flexed into a U-shape in plan and projected down into the bowl and includes a plurality of spaced clips and stop flanges which supportably engage over and around the toilet rim to prevent unwanted overspray.

U.S. Pat. No. 6,183,850 ('850 patent), which issued to Lauer, discloses certain Target Devices. The '850 patent describes A toilet target device comprising a water-dispersible foam polymer target floating in a toilet bowl or resting in a potty or urinal is provided. Also provided is a toilet target containing a fragrance, a method for preparing a toilet target, and a method for promoting potty training for children.

U.S. Pat. No. 6,772,454 ('454 patent), which issued to Barry et al., discloses a Toilet Training Device. The '454 patent describes a toilet training device having a target sensor for sensing an impact of urine, a first suction cup for securing the target sensor to a toilet, a music box for providing a feedback, and an insulated electric wire for connecting the target sensor with the music box. The target sensor can be positioned unobtrusively within the toilet. When a user urinates, the target sensor detects an impact of the urine when hit, and the target sensor triggers music in the music box through the insulated electric wire.

U.S. Pat. No. 6,811,403 ('403 patent), which issued to Camarena, discloses a Method for Biodegradable Material Having Water and Uric Acid Activated Color Images. The '403 patent describes a chemically treated biodegradable material having an image impregnated therein that is only viewable by absorption of uric acid. A mature image is produced on the biodegradable material by reaction with urine to become visible and is designed to encourage infants to use the potty when having to urinate. The invention reveals a dark outline or sketch of the actual image when reacting to water only. This way the child is still encouraged to make the effort to get to the potty. However, only when uric acid or urine is detected by the present invention will bright and vibrant colors be revealed giving the potty training to an even greater surprise and even greater reason for wanting to see the images which form when he potties.

U.S. Pat. No. 6,908,392 ('392 patent), which issued to Friedman et al., discloses a Target Game Apparatus and System for Use with a Toilet. The '392 patent describes an apparatus and system for a target game used in conjunction with a toilet or urinal, wherein a target body is positioned within the toilet basin. The target game comprises a target body and coupling members, wherein the target body is divided into sections. The coupling members secure the target body to the toilet basin and include a securing member and an attachment member, wherein the securing member is any device that is capable of attaching to the toilet and wherein the attachment member couples the securing member to the target body. Other embodiments of the apparatus and system include image projection systems to create the target.

U.S. Pat. No. 7,017,198 ('198 patent), which issued to Conn et al., discloses a Potty Protector Urine Shield with Centered Targets. The '198 patent describes a flexible protector urine shield when flat is rectangular-shaped with rounded corners at the top. A handle on the protector shield provides easy of use when placing and removing shield. It mounts with front and back support rods, which lie on top of the rim. The front rod allows for targets to be placed in the center of the toilet to train boys to aim more efficiently.

U.S. Pat. No. 7,373,673 ('673 patent), which issued to Holland discloses a Target Built into a Toilet or Urinal. The '673 patent describes a target permanently manufactured into a toilet or urinal used as a self competitive game that triggers the subconscious mind as a training aide to revolutionize the world in health and hygiene. The user scores points by hitting the target in different locations. Closer to the center gives the individual more points.

U.S. Pat. No. 8,112,828 ('828 patent), which issued to Varela, III, discloses a Toilet Anti-Splatter Apparatus. The '828 patent describes a toilet anti-splatter apparatus limits urine splash in a toilet. The apparatus is provided in a plurality of sheets, all combined in a stack with one edge having a releasable bond. Each sheet provides a floating target with a target arrangement containing a foaming agent. Upon water contact, the surfactant foaming agent foams, thereby diminishing splatter. The sheets are disposable and biodegradable and further inhibit splatter by floating until flushed. Available embodiments of the apparatus include those with bactericidal and fungicidal chemicals within the center capsule. Further embodiments contain dyes to encourage target strike by the user.

United States Patent Application No. 2006/0260497, which was authored by Kneese et al., describes a device and method for facilitating potty training. Preferably, the device and method encourage a child to urinate and/or perform bowel movements in a toilet. Further, preferably, the device and method are useful for both boys and girls alike. Further preferably, the device and method provide for the child to sit backward on the toilet seat to maintain balance and to focus his/her attention on the device. Still further, preferably, the device and method are safe for the environment and surrounding population.

United States Patent Application No. 2006/0260497, which was authored by Neale et al., describes a toilet training apparatus comprising a central sheet and at least one extension associated with the central sheet, said at least one extension having a shape such that if the central sheet is placed in a commode of a toilet, at least one extension is in at least partial contact with a portion of the interior of said commode. In some embodiments the central sheet is comprised of a material that will allow urine to at least partially pass through it. In some embodiments, the central sheet can include a design.

United States Patent Application No. 2010/0003655 which was authored by Stephenson, Jr., describes a toilet training aid that is temporarily applied inside an existing toilet bowl or urinal in order to help teach male toddlers (or any age) to aim their stream of urine inside the toilet bowl or urinal. The toilet training aid is uniquely designed help keep male toddlers concentration by giving the toddler a target to aim at in the toilet bowl or urinal while allowing him to work on his hand and eye coordination of hitting the target in the toilet bowl or urinal. Thus the toilet training aid expedites the process of teaching male toddlers to control their stream of urine into the toilet bowl or urinal while making it a positive experience.

It will be seen from a review of the foregoing in particular, and the field of toilet training devices in general that the prior art perceives a need for a urine stream target device, floatable upon the water surface within a toilet bowl and color changeable according to hydrogen ion concentrations in the urine streams directed at the target device. Accordingly, the present invention provides a multi-layer urine stream target device for providing a floatable yet color changeable target assembly, which changes color depending from urine pH levels as summarized in more detail hereinafter.

SUMMARY OF THE INVENTION

The present invention is developed to aid non-potty trained children to urinate in a toilet. In this regard, a urine stream target device is provided that will provide the child with a focal point in the toilet to target when the child urinates. The target device floats on top of a water surface within a toilet bowl.

The target device is developed with a view toward providing the child positive feedback when the child's urine stream makes contact with the floating target. The child will receive positive feedback when the target device changes color when urinated upon. The target device is easily placed into the toilet bowl, is flushable, and degradable. The target device is a single use product.

The urine stream target devices according to the present invention comprise a multi-ply arrangement. The upper layer(s) will comprise a filter paper impregnated with certain pH-indicating means as well as have a pigment ink stamp applied to the top. A "pigment" type ink is important because other types of ink (dye and permanent solvent-based) may cause premature color change of the target device(s).

The lower layer of the target device is a clear tape with a water-based (i.e. water soluble) adhesive product. The adhesive of the adhesive tape is water-based and dissolves relatively quickly. The tape creates a temporary hydrophobic barrier between the upper layer of the target device(s) and the water in the toilet bowl The manufacturing steps for the target device(s) can be summarized as follows:

1. Soak the filter paper in aqueous NaOH solution of an approximate pH=12.5.
2. Allow the filter paper to dry flat.
3. Soak the filter paper in pH indicator in solution.
4. Allow the filter paper to dry flat.
5. Apply a uniform layer of tape to one side of the filter paper.
6. Using a custom press, stamp out circles (approximately 7.0 cm diameter). The press will cut the filter paper into a circle and simultaneously create an outer rim of approximately 0.5 cm. The press has an air manifold situated under the target devices that will gently remove the target devices from the wells of the press when the target devices are finished.
7. A character is stamped onto the middle of the target device using pigment ink
8. The target devices are stacked in groups of 20 and placed in an opaque jar with a screw top lid. (This will maintain the effectiveness of the pH indicator). The jar will assist in maintaining the configuration of the target device(s).

The pH indicators that are used change the white filter paper upper layer to a certain color when the paper absorbs the pH indicator solution and it is allowed to dry. After the paper-based upper layer has air dried, a select pH indicator is selected from the group consisting of litmus, methyl red and a universal pH indicator. The filter paper is soaked in one of these solutions and then allowed to dry. At this point, the filter paper is colored.

The litmus pH indicator in solution, for example, turns the paper blue. This is the color that litmus will turn in a basic pH environment. The methyl red pH indicator will turn the paper yellow in a basic pH environment. The universal pH indicator will turn the filter paper green in a basic pH environment. All three pH indicators will turn to a red or reddish-orange color in an acidic pH environment, i.e. when the urine hits the surface of the target device.

A fanciful character is stamped in white pigment ink atop the blue/yellow/green coloration provided by the pH indicator compound. The target devices will have the same coloration (blue/yellow/green) as viewed from the top and bottom, with the exception of the fanciful character as viewed upon the upper surface of the upper layer.

BRIEF DESCRIPTION OF THE DRAWINGS

Other features of our invention will become more evident from a consideration of the following brief descriptions of illustrations of the subject invention:

FIG. 2(*a*) is a first longitudinal cross-sectional side view of the urine stream target device according to the present invention.

FIG. 5(*a*) is a fragmentary cross-sectional side view of a generic toilet bowl construction with a water supply being flushed and a degraded urine stream target device according to the present invention with second coloration.

FIG. 6(*b*) is a second sequential diagrammatic side view depiction of the first or upper layer of material submerged in the first solution otherwise depicted in FIG. 6(*a*).

FIG. 7(*b*) is a fourth sequential diagrammatic side view depiction of the first or upper layer of material removed from the first vessel shown in FIG. 7(*a*) and allowed to dry flat upon a non-porous surface.

FIG. 8(*b*) is a sixth sequential diagrammatic side view depiction of the first or upper layer of material submerged in the second solution otherwise depicted in FIG. 8(*a*).

FIG. 9(*b*) is an eighth sequential diagrammatic side view depiction of the first or upper layer of material removed from the vessel shown in FIG. 9(*a*) and allowed to dry flat upon a non-porous surface.

FIG. 10(*b*) is a diagrammatic side view depiction of the structures otherwise shown in FIG. 10(*a*) attached to one another.

FIG. 10(*c*) is a fragmentary enlarged cross-section view as sectioned from FIG. 10(*b*) enlarged to show an adhesive layer intermediate the first or upper layer of material and the second or lower layer of material.

FIG. 17 is a bottom perspective view of a ink stamp shown in perspective to show an outline, the ink stamp being juxtapositioned in superior adjacency to an ink reservoir.

FIG. 18 is a side view of the ink stamp otherwise depicted in FIG. 17 shown stamping an image upon the upper surface of the upper layer of the urine stream target device according to the present invention.

FIG. 19 is a top plan view of the urine stream target device according to the present invention showing the stamped image upon the upper surface of the upper layer.

FIG. 20 is a second longitudinal cross-sectional side view of the urine stream target device according to the present invention.

FIG. 20(*a*) is an enlarged fragmentary cross-sectional view of the urine stream target device otherwise shown in FIG. 20, enlarged to more clearly show the multilayer arrangement inclusive of a stamped image ink layer.

FIG. 21(*a*) is a top perspective view of the structures otherwise shown in FIG. 21 shown in a packaged state.

DETAILED DESCRIPTION OF THE PREFERRED EMBODIMENT AND METHODOLOGY

Figure 1:
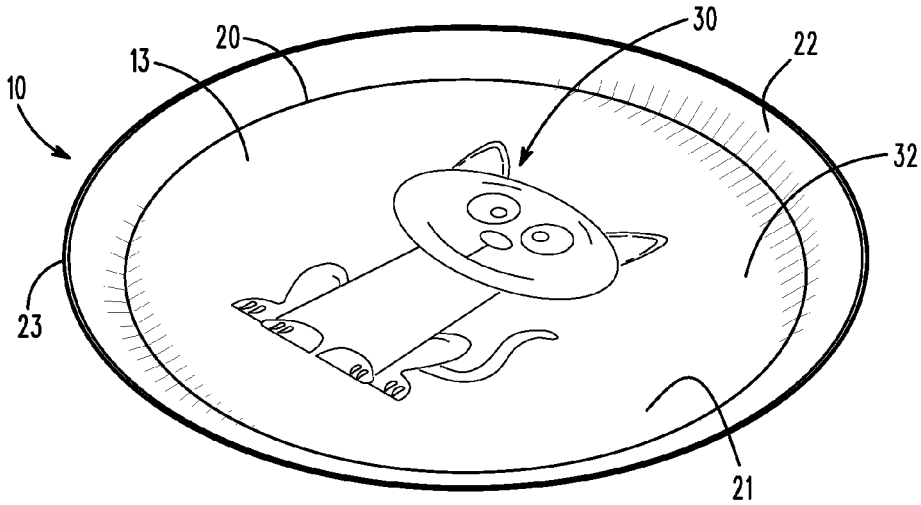
FIG. 1 is a top perspective view of the urine stream target device according to the present invention.

Referring now to the drawings with more specificity, the preferred embodiment of the present invention provides a floatable, multi-layer or multi-ply urine stream target device as depicted and referenced at 10. The urine stream target device 10 according to the present invention is primarily designed to be placed within a toilet bowl as at 11 and floatable atop water surfacing 12 contained by the bowl 11. Once the urine stream target device 10 is so placed, it is contemplated that the target device 10 may effectively serve as a toilet training aid for (male) youngsters as summarized hereinabove.

As indicated, the urine stream target device 10 according to the present invention preferably comprises multiple layers, including a urine-receiving absorbent upper layer as at 13; a water-contacting non-absorbent lower layer as at 14; an adhesive layer as at 15 for adhesively attaching the upper layer 13 to the lower layer 14; and certain pH-indicating means absorbed by the upper layer 13. Further, the upper layer 13 may be outfitted with an ornamental marking or fanciful character as at 30 as a means to enhance the attractiveness of the target device 10 to the urine stream provider.

In this last regard, the relatively absorbent upper layer 13 is impregnated with certain pH-indicating means and floatable upon a toilet bowl water surface 12 via the relatively non-absorbent lower layer 14. The upper layer 13 preferably comprises a first color as provided by the pH-indicating means. In this regard, and comparatively referencing FIGS. 3 and 5, the reader will see that the target device 10 has been depicted as comprising blue coloration (i.e. litmus type pH indicating means) as represented by horizontal hatch markings 100.

Figure 3:
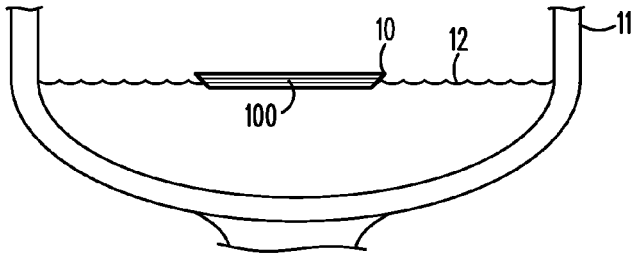
FIG. 3 is a fragmentary cross-sectional side view of a generic toilet bowl construction with a water supply and the urine stream target device according to the present invention with first coloration floating upon the water supply.
Figure 4:
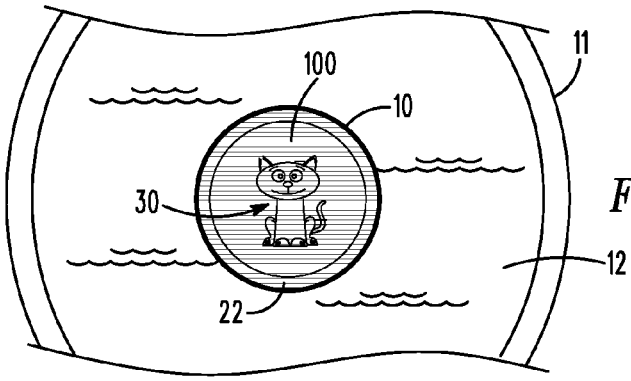
FIG. 4 is a fragmentary top plan view of a generic toilet bowl construction with a water supply and the urine stream target device according to the present invention with first coloration floating upon the water supply.
Figure 5:
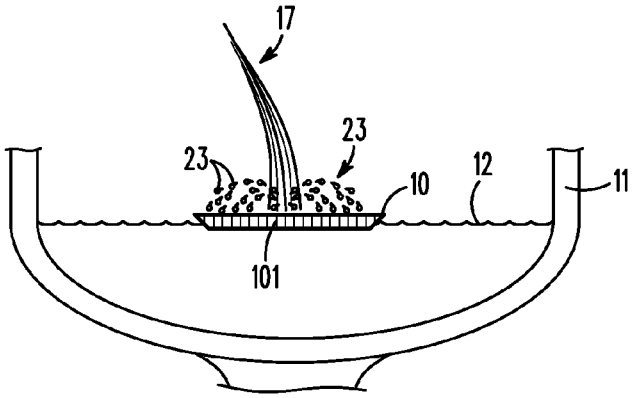
FIG. 5 is a fragmentary cross-sectional side view of a generic toilet bowl construction with a water supply and the urine stream target device according to the present invention with second coloration floating upon the water supply, the second coloration being effected by a urine stream.
Figure 5:
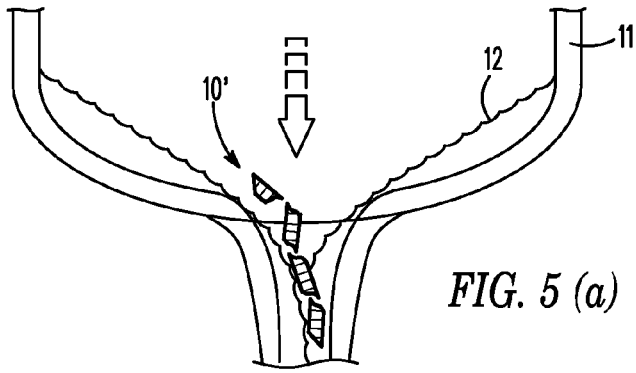

The pH-indicating means, absorbed in the upper layer 13, cause a color change in the upper layer 13 when urine or a urine stream 17 (having a differing pH than the absorbed pH-indicating means) comes into contact therewith as generally and comparatively depicted in FIGS. 3-5. FIG. 5, for example, attempts to depict a color change in contrast to FIGS. 3 and 4. Whereas FIGS. 3 and 4 depict blue coloration of the upper layer 13 via markings 100, FIG. 5, inclusively depicting a urine stream 17 contacting the device 10, further depicts red coloration as represented by vertical hatch markings 101.

It is contemplated that by providing a dynamic color change of this type, the (male) youngster is more apt to target the urine stream target device 10 with a urine stream 17 and, over repeated urine stream events, will become more properly toilet trained. Accordingly, the urine stream target device 10 according to the present invention changes color when coming into contact with a urine stream 17 directed thereagainst for aiding in toilet training a urine stream provider as exemplified by male youngster.

Figure 2:
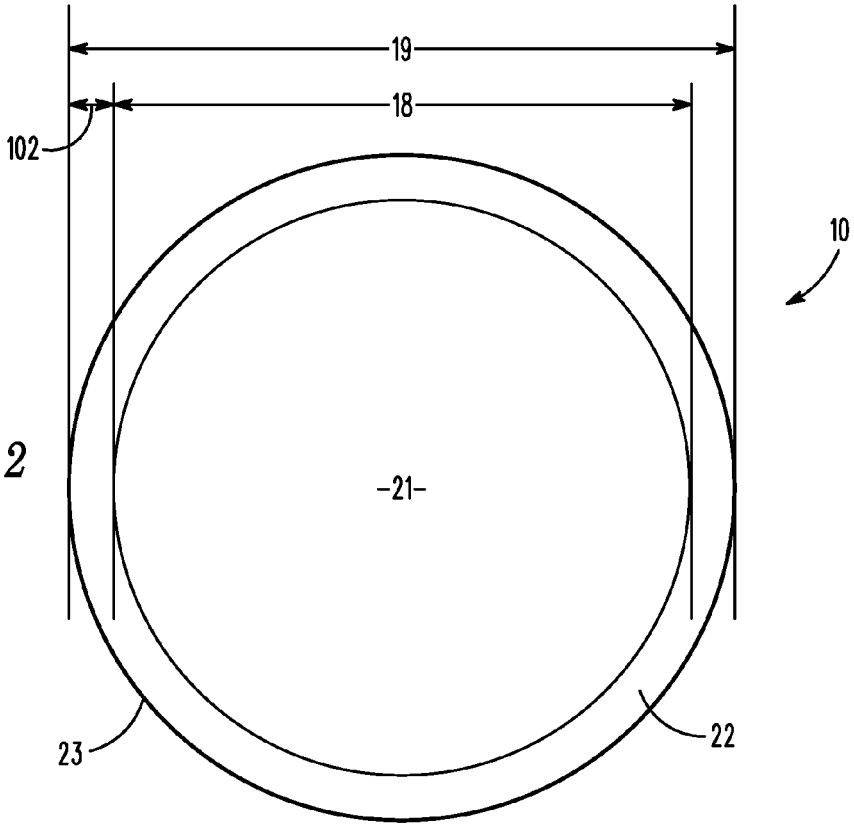
FIG. 2 is a bottom plan view of the urine stream target device according to the present invention.
Figure 2:
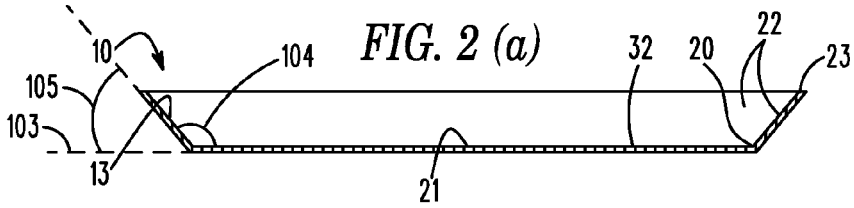

The urine stream target device 10 according to the present invention is preferably round or oblong in plan view and thus preferably comprises a rounded or oblong transverse cross-section and a generally U-shaped longitudinal cross-section such that the target device 10 comprises a first diameter as depicted and referenced at 18 and a second diameter as depicted and referenced at 19 in FIG. 2. Notably, the so-indicated U-shape comprises relatively abbreviated and angled upstanding elements as at angled upper section 22.

The first diameter 18 defines a junction site 20 intermediate a planar lower section 21 and an angled upper section 22. An upper rim 23 of the angled upper section 22 essentially defines the second diameter greater 19, which diameter 19 is preferably greater in magnitude than the first diameter 18. The distance (as at 102) from the junction site 20 to the upper rim 23 is preferably 0.5 cm as referenced in FIG. 2.

The urine stream target device 10 according to the present invention thus resembles a tray or disc-shaped boat for flotation atop the water surface 12. The angled upper section 22 is preferably angled greater than 30 degrees from the plane 103 of the planar lower section 21 as generally depicted in FIG. 1(*a*). Stated another way, the angle 104 between the upper section 22 and the lower section 21 is preferably no greater than 150 degrees, with an exemplary or preferred angle 104 of 135 degrees or 45 degrees as at angle 105. Such angles 104 or 105 provide excellent results for preventing water from contacting the upper layer 13, while simultaneously catching, redirecting and/or collecting urine droplets 23 from urine streams 17.

The upper layer 13 preferably comprises or is constructed from a paper-based material as exemplified by WHATMAN® brand, Grade 1 filter paper, Catalog Number 1001-929, 11 micron particle retention in liquid, 180 micron thickness, 60 cm×60 cm sheet with medium porosity and medium flow rate. The upper layer 13, comprising or being constructed from this material, is initially white in coloration. The (combination) lower layer 14 and adhesive layer 15 are preferably provided together as a clear or transparent adhesive tape construction as exemplified by FELLOWES® brand Self-Adhesive Laminating Roll, 3 mil, 16 inches by×10 feet clear. This high-performance tape comprises an acid-free, water-based adhesive.

Excellent results have been achieved utilizing FELLOWES® self-adhesive laminating roll of the foregoing type and thus this tape construction is exemplary insofar as it creates a temporary hydrophobic barrier between the upper layer 13 of the target device 10 and the water surface 12 in the toilet bowl 11. Further, this type of adhesive tape dissolves in water given its water-based adhesive layer 15, and thus the target device 10 is able to more readily degrade as generally depicted in FIG. 5(*a*), as for example, following a flushing event of the urine-treated water from the toilet bowl 11. A degraded urine stream target device is depicted and referenced at 10', which will typically occur in or after about 30 minutes upon standing water.

A single urine stream target device 10 according to the present invention may preferably be formed by cutting a piece of the first absorbent material used to construct the upper layer 13 into a circular form about 7.0 cm in diameter as at 107. The round piece of material or upper layer 13 is first soaked in an aqueous alkaline or basic solution comprising sodium hydroxide and water for about 5 minutes or until fully saturated.

Figures 6, 7, 8, 9:
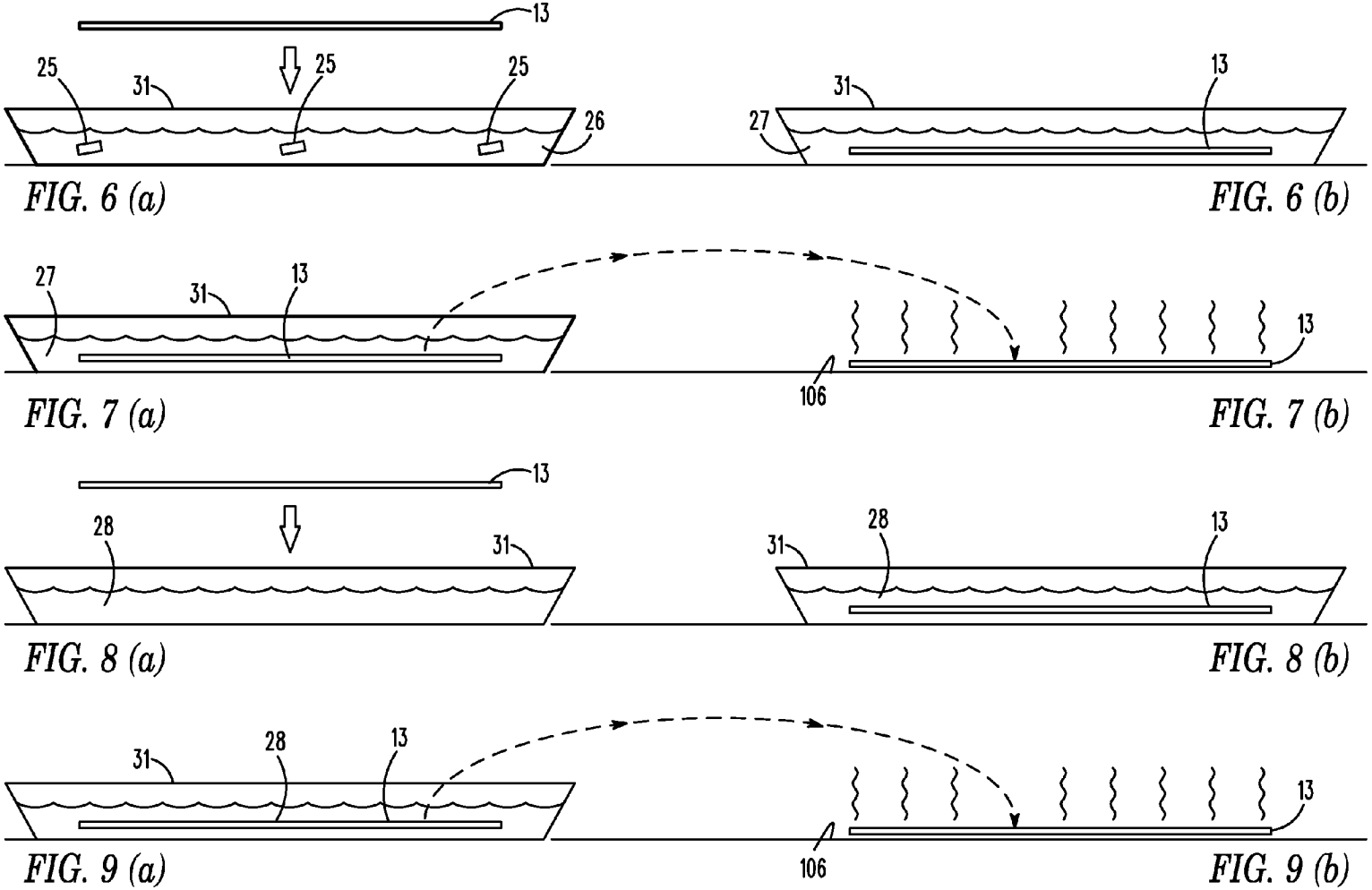
FIG. 6(*a*) is a first sequential diagrammatic side view depiction of a first or upper layer of material being placed into a first vessel containing alkaline compounds in pellet form and water for forming a first solution via dissolving action of the pellets in the water.
FIG. 7(*a*) is a third sequential diagrammatic side view depiction of the first or upper layer of material submerged in the first solution otherwise depicted in FIGS. 6(*a*) and 6(*b*).
FIG. 8(*a*) is a fifth sequential diagrammatic side view depiction of the first or upper layer of material being placed into a second vessel containing a second solution.
FIG. 9(*a*) is a seventh sequential diagrammatic side view depiction of the first or upper layer of material submerged in the second solution otherwise depicted in FIGS. 8(*a*) and 8(*b*).

The sodium hydroxide ingredient may preferably be provided in the form of pellets 25 and added to distilled water 26 to form the solution 27 in which the upper layer 13 is immersed as generally and comparatively depicted in FIGS. 6(*a*), 6(*b*), and 7(*a*). The preferred or target pH of the solution 27 is 12.5. After soaking the upper layer 13 in the solution 27, the upper layer 13 is removed and allowed to dry flat on a non-porous surface 106 as generally and comparatively depicted in FIGS. 7(*a*) and 7(*b*) thereby rendering a basic environment throughout the upper layer 13.

The absorbent first material or upper layer 13 is then re-soaked in a pH indicator solution 28 thereby coloring the first absorbent material or upper layer 13 with a first color (e.g. blue coloration). The pH indicating means as enabled by way of the pH indicator solution 28 may preferably be selected from the group consisting of methyl red pH indicator, universal pH indicator or litmus pH indicator solutions. Depending on the type of pH indicator solution used, the first color or color before urine stream contact will be different.

The methyl red pH indicator, for example, will turn the (white) upper layer 13 yellow in a basic pH environment. The methyl red pH indicator solution may preferably be formed by dissolving powdered pH indicator (CAS 493-52-7) sufficient quantity to 750 mL of 91% isopropyl alcohol to make a saturated solution. The liquid may be preferably decanted into a 9 inch×13 inch, 3 quart Pyrex dish to serve as a soaking vessel. Generic soaking vessels are depicted and referenced at 31.

The litmus pH indicator in solution turns the filter paper or upper layer 13 blue. In other words, this is the color that litmus will turn in a basic pH environment as generally depicted in FIGS. 3 and 4 at blue coloration hatch markings 100. The litmus pH indicator solution may preferably be formed by dissolving litmus powder pH indicator in distilled water. Litmus powder, CAS 1393-92-6, for example, may be preferably dissolved in sufficient quantity to 200 mL of distilled water to make a saturated solution. The liquid may then be poured into a small plastic bowl. The upper layer 13 should be soaked in the litmus pH indicator solution for about 30 minutes.

The universal pH indicator will turn the filter paper or upper layer 13 green in a basic pH environment. The universal pH indicator may be purchased in solution.

Universal pH indicator comprises the following: isopropyl alcohol CAS 67-63-0, water CAS 7732-18-5, methyl alcohol CAS 67-56-1, methyl red sodium salt CAS 845-10-3, bromothymol blue sodium salt CAS 34722-90-2. The user may be preferably directed to add sufficient quantity of the universal pH indicator solution to a 9 inch×13 inch, 3 quart Pyrex dish to enable a fully submerged upper layer 13.

All three of these exemplary pH indicators will turn to a red or reddish-orange color in an acidic pH environment (as depicted with red coloration hatch markings 101 in FIG. 5). In other words, when the urine stream 17 comes into contact with the upper layer 13, the upper layer 13 of the urine stream target device 10 will change from blue to red in this example and as comparatively depicted in FIGS. 3-5.

Figure 10:
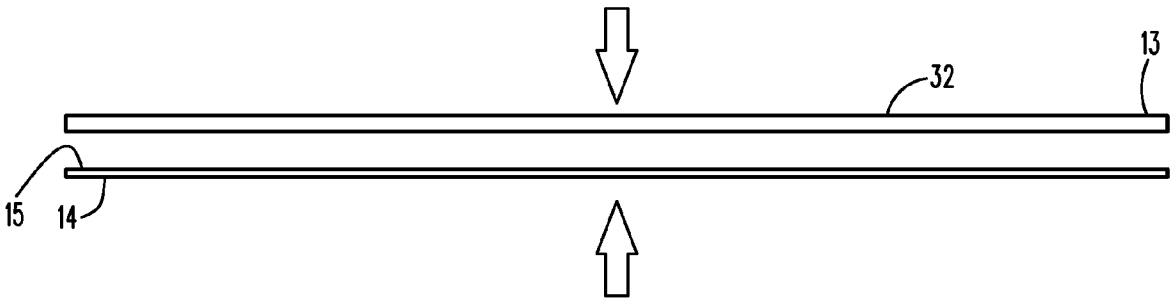
FIG. 10(*a*) is a diagrammatic side view depiction of a first or upper layer of material of the target device being directed toward a second or lower layer of material of the target device.
Figure 10:
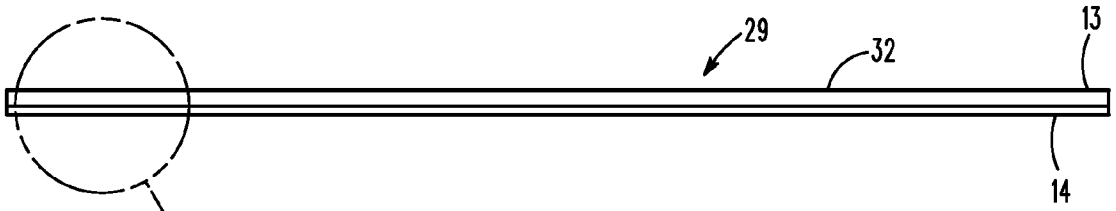
Figure 10:
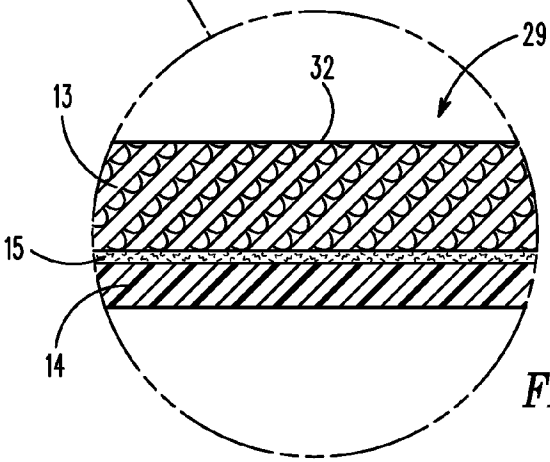

After the upper layer 13 is soaked in a pH indicator solution 28 (for about 5 minutes) as generally and comparatively depicted in FIGS. 8(*a*) and 8(*b*), the upper layer 13 is removed from the solution 28 and allowed to dry flat on a non-porous surface 106 as generally and comparatively depicted in FIGS. 9(*a*) and 9(*b*). When the upper layer 13 is dry, a non-absorbent second material as exemplified by the adhesive tape (or combination lower layer 14 and adhesive layer 15) is adhesively applied to the absorbent first material or upper layer 13 thereby forming a multilayer arrangement 29 as generally depicted and referenced in FIGS. 10 and 10(*a*).

A fanciful character or ornamental marking 30 may then be preferably applied to the upper surface 32 of the upper layer 13. In this regard, the character or marking 30 may be stamped to the upper surface 32 preferably using a pigmented ink 33 placed upon the stamp. A generic stamp is depicted and referenced at 34 in FIGS. 17 and 18.

The fanciful character or ornamental marking 30 may preferably take the form of animals, vehicles, symbols and shapes. The pigmented ink marking 30 is then allowed to dry on a flat surface. The use of pigmented ink 33 is to be preferred as a means to prevent inadvertent color changes when the marking 30 comes into contact with water, whether from the toilet-based reservoir or whether from the water content in the urine stream 17.

Figure 11:
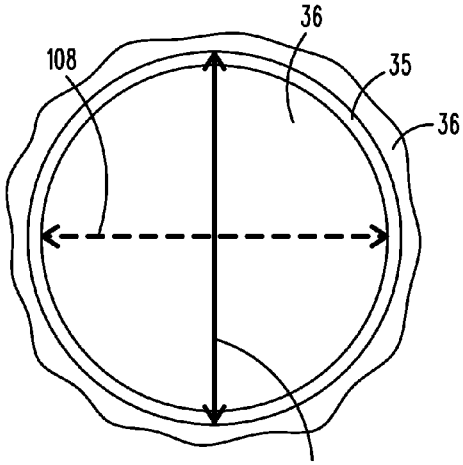
FIG. 11 is a top plan view of a lower press section used to form the urine stream target device according to the present invention.
Figure 12:
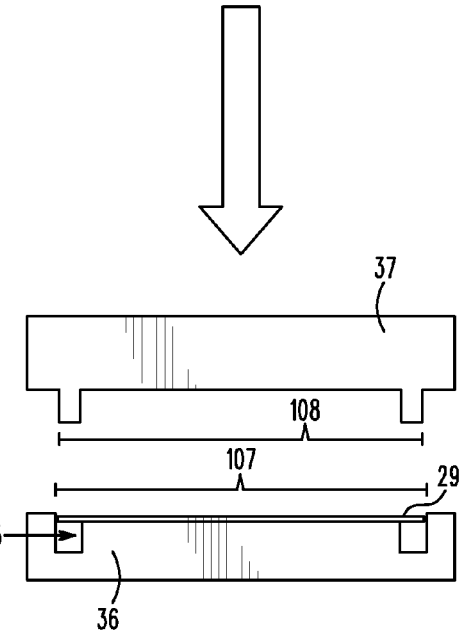
FIG. 12 is a first sequential diagrammatic side view depiction of an upper press section being directed toward a lower press section for forming the urine stream target device from a multilayer arrangement according to the present invention.
Figure 13:
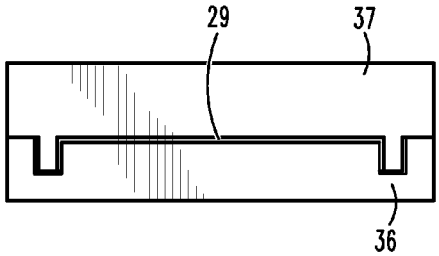
FIG. 13 is a second sequential diagrammatic side view depiction of the structures otherwise shown in FIG. 12 showing the upper and lower press sections forming the urine stream target device from the multilayer arrangement according to the present invention.
Figure 14:
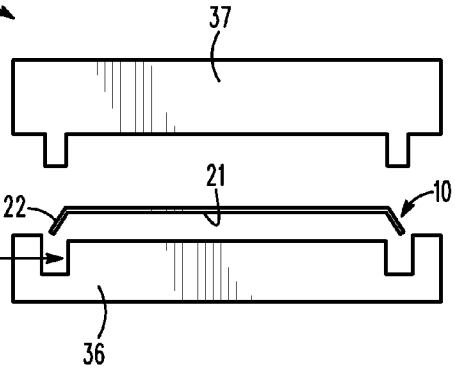
FIG. 14 is a third sequential diagrammatic side view depiction of the structures otherwise shown in FIGS. 12 and 13 showing the upper and lower press sections being directed away from one another for releasing the formed urine stream target device according to the present invention.

The cup, tray or boat shape of the target device 10 (i.e. the planar lower section 21 and the angled upper section 22) may preferably be formed by concentrically placing the multilayer arrangement 29 over a circular opening 35 having a 6.5 cm inner diameter formed in a inert, solid, non-porous material 36 as generally depicted in FIG. 11. An inert, solid, non-porous second material 37 with an approximate 6.9 cm outer diameter as at 108 may then be used to push (as at vector 109) the multilayer arrangement 29 into the opening 35 and form the boat-effect as generally and comparatively depicted in FIGS. 11-14.

Figure 15:
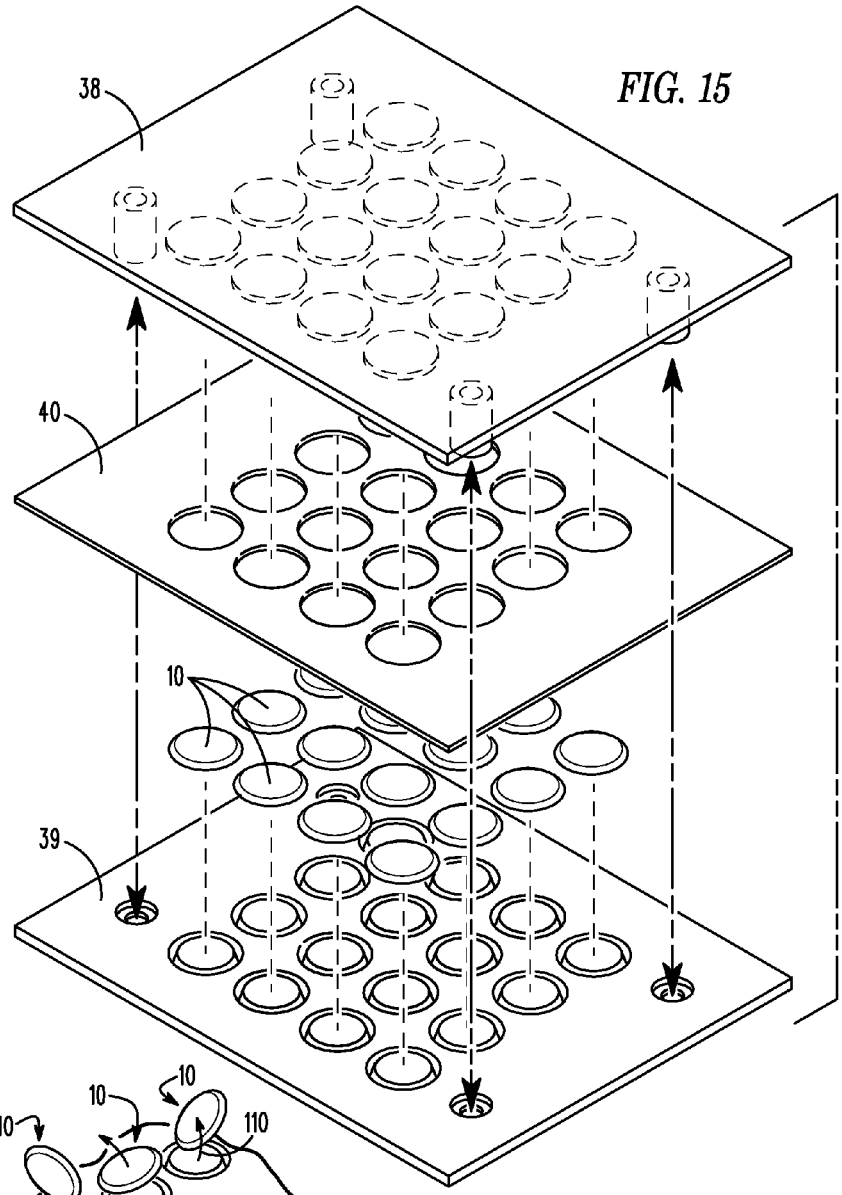
FIG. 15 is an exploded top perspective view of a press assembly comprising an upper and a lower press assembly arrangement and multilayer material arrangement whereby the press assembly may be operated to press the multilayer arrangement to form a series of urine stream target devices.
Figure 16:
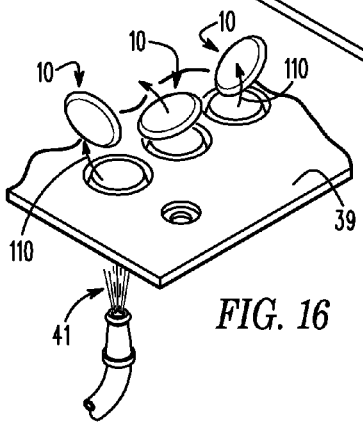
FIG. 16 is a fragmentary top perspective view of a section of the lower press assembly arrangement and showing a device for delivering an air burst to force the formed urine stream target devices from the lower press assembly arrangement.

FIGS. 15 and 16, by contrast, show an upper press arrangement 38 (akin to material 37) and lower press arrangement 39 (akin to material 36) for cutting or forming multiple urine stream target devices 10 via a single pressing/cutting action. A sheet 40 of the multilayer arrangement 29 is received intermediate the upper press and lower press arrangements 38 and 39 and press-cut to form multiple target devices 10. Referencing FIG. 16, the reader will understand that an optional method of removing the target devices 10 from the lower press arrangement 39 is to direct a burst of air 41 against the target device(s) 10 to force 110 the device(s) 10 from the arrangement 39.

Figure 21:
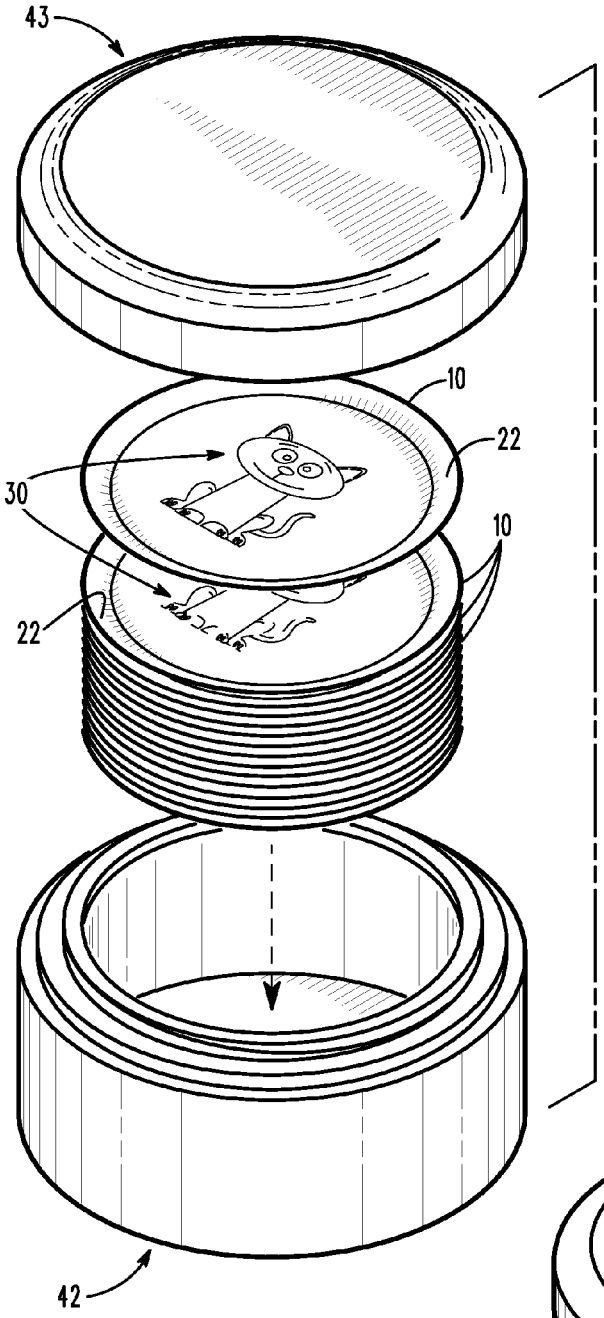
FIG. 21 is an exploded top perspective view of, from top to bottom, a container cover, a series of stacked urine stream target devices, and a container bottom.
Figure 21:
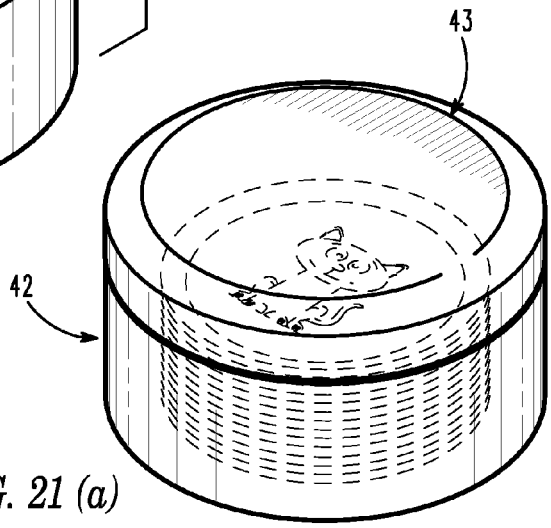

Referencing FIGS. 21 and 21(*a*), it will be seen that multiple urine stream target devices 10 may then be stacked, for example, in stacks of 20 and placed in an opaque jar 42 with a screw top lid 43 for packaging purposes. The target devices 10 essentially nest when stacked, and the stacked arrangement helps maintain the effectiveness of the pH indicating means. Further, the jar 42 effectively assists in maintaining the configuration of the target devices.

While the foregoing specifications set forth much specificity, the same should not be construed as setting forth limits to the invention but rather as setting forth certain preferred embodiments and features. For example, as prefaced hereinabove, it is contemplated that the present invention essentially provides a floatable multi-layer urine stream target device 10 for placement within a toilet bowl 11 atop a water surface 12 for use as a toilet training aid. The target device 10 according to the present invention is believed to essentially comprise a urine-receiving upper layer of relatively absorbent material (as at 13); a water-contacting lower layer of relatively non-absorbent material (as at 14); an adhesive layer (as at 15) for adhesively attaching the upper layer to the lower layer; and certain pH-indicating means.

The pH-indicating means (broadly embracing both the alkaline compound and the pH indicating compounds) are absorbed by the upper layer. The upper layer being thus impregnated with the pH-indicating means is floatable upon a toilet bowl water surface via the lower layer. The upper layer has a first color prior to contact with a urine stream by virtue of the pH indicating means. The pH-indicating means causes a color change in the upper layer when urine comes into contact therewith, which color change is believed to aid in toilet training a urine stream provider.

The target device preferably comprises a rounded transverse cross-section and a roughly U-shaped longitudinal cross-section such that the target device comprises a first diameter and a second diameter. The first diameter defines a junction site intermediate a planar lower section and an angled upper section. An upper rim of the angled upper section defines the second diameter greater, which second diameter is preferably greater in magnitude than the first diameter.

The target device further preferably comprises an alkaline compound, the alkaline compound being pre-absorbed by the upper layer for rendering the upper layer a basic environment, the basic environment for enhancing color changing characteristics of the target device. The pH-indicating means are preferably defined by a select pH indicator selected from the group consisting of a methyl red pH indicator, a universal pH indicator or a litmus pH indicator solution.

The target device may further preferably comprise an ornamental marking, the ornamental marking being applied atop the upper layer within the first diameter for visually attracting the urine stream provider. The ornamental marking preferably comprises a pigment ink for preventing inadvertent color changes upon the upper layer.

The preferred angle between the upright walls or angled upper section 22 and the planar bottom or lower section 21 of the target device 10 has a wide tolerance, but it should be greater that approximately 30-degrees from the plane of the planer bottom to the lower layer of the upright wall. Preferably, the angle is 45-degree angles or greater. The upright walls give at least three advantages to the device. First, the upright walls or angled upper section helps to provide buoyancy to the target device (similar to a raft or boat).

Second, the angled upper section provides a barrier that prevents the water in the toilet bowl from splashing onto the top of the target device. If there is excess water that lands on top of the target device, then the acidity of the urine is lessened because the urine is now more dilute. The result of excess water on top of the target device is a diminished color change because there is less acid at the target device surface to force the pH of the impregnated pH indicator to decrease, therefore forcing the pH indicator through its transition point (color change).

In addition to the diluted urine, as described previously, the buoyancy is negatively affected due to the added weight on the target device and no increase in water displacement. Thirdly, the upright wall or angled upper section provides the consumer a place to hold onto the target device without touching the planar surface.

In some cases, it may be possible for liquids on the consumers' fingers to initiate color change. For example, an adult may have just been in the kitchen working with lemons and then go to use the target devices without washing their hands. The lemon juice would cause a color change to the surface of the target device. This situation is acceptable as long as it is on the upright walls, because the planar area is still untouched.

It is further contemplated that certain toilet training methods and methods of manufacture may be properly supported by the foregoing specifications. In this regard, the present invention is believed to further provide a toilet training method comprising the steps of: providing a urine stream target device substantially as previously specified; floating the target device upon a water surface within a toilet bowl via the lower layer, thereby properly positioning the target device for a urine stream provider; targeting the target device with a urine stream provided by the urine stream provider, the pH-indicating means causing a color change in the upper layer when urine comes into contact therewith, which color change aids in toilet training the urine stream provider.

Still further, target device manufacturing method is believed to be supported, which method comprising the steps of: soaking an absorbent first material in a basic solution; drying the absorbent first material; re-soaking the absorbent first material in a pH indicator solution thereby coloring the first absorbent material with a first color; re-drying the absorbent first material with the first color; adhesively applying a non-absorbent second material to the absorbent first material thereby forming a multilayer arrangement; and cutting at least one target device from the multilayer arrangement.

The manufacturing method may further comprise the step of stamping an ornamental marking to an upper surface of the first absorbent material, which ornamental marking comprises a second color different than the first color, and which ornamental marking comprises a pigment ink for preventing inadvertent color change of the first color.

Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures and the appended drawings.

We claim:

1. A multi-layer urine stream target device usable as a toilet training aid, the target device comprising:

an upper layer of a first material;

a lower layer of a second material attached to the upper layer;

pH-indicating means for indicating pH; and an alkaline compound, the pH-indicating means and the alkaline compound being absorbed by the first material thereby providing the first material with a first color and rendering the upper layer with a basic environment, the upper layer being floatable upon a water surface via the lower layer, the pH-indicating means causing a color change in the first material when urine comes into contact therewith, the color change for aiding in toilet training a urine stream provider, the basic environment for enhancing color change characteristics of the target device.

2. The target device of claim 1 wherein the pH-indicating means comprise a select pH indicator, the select pH indicator being selected from the group consisting of a methyl red pH indicator, a universal pH indicator or a litmus pH indicator.

3. The target device of claim 1 comprising a rounded transverse cross-section and an angled upper section defining a first diameter and a second diameter, the first diameter defines a junction site intermediate a planar lower section and the angled upper section, an upper rim of the angled upper section defining the second diameter, the second diameter being greater in magnitude than the first diameter.

4. The target device of claim 3 wherein the lower layer at the angled upper section is angled greater than 30 degrees from a lower section plane of the lower section.

5. The target device of claim 1 wherein the first material is a paper-based material.

6. The target device of claim 1 wherein the lower layer is adhesive attached to the upper layer via an adhesive layer, the adhesive layer being water-based for enhancing degradation of the target device.

7. The target device of claim 1 comprising an ornamental marking, the ornamental marking being applied to an upper surface of the upper layer for visually attracting the urine stream provider.

8. The target device of claim 7 wherein the ornamental marking comprises a pigment ink, the pigment ink for preventing inadvertent color changes upon the upper layer.

9. A toilet training method, the toilet training method comprising the steps of:

providing a wine stream target device, the urine stream target device comprising:

an upper layer of a first material;

a lower layer of a second material attached to the upper layer;

a rounded transverse cross-section;

an angled upper section defining a first diameter and a second diameter, the first diameter defining a junction site intermediate a planar lower section and the angled upper section, an upper rim of the angled upper section defining the second diameter the second diameter being greater in magnitude than the first diameter; and pH-indicating means for indicating pH, the pH-indicating means being absorbed by the first material, the upper layer thereby being provided with first coloration;

floating the target device upon a water surface via the lower layer, thereby properly positioning the target device for a urine stream provider; and targeting the target device with a urine stream provided by the urine stream provider, the pH-indicating means causing a color change in the upper layer when urine comes into contact therewith, the color change for aiding in toilet training the urine strewn provider.

10. The toilet training method of claim 9 wherein the target device is formed such that the lower layer at the angled upper section is angled greater than 30 degrees from a lower section plane of the lower section.

11. The toilet training method of claim 9 wherein the target device is formed such that the lower layer is adhesively attached to the upper layer via an adhesive layer, the adhesive layer being water-based for enhancing water-based degradation of the target device.

12. The toilet training method of claim 9 comprising wherein the target device is formed such that the first material comprises an absorbed alkaline compound, the absorbed alkaline compound for rendering the upper layer a basic environment, the basic environment for enhancing color change characteristics of the target device.

13. The toilet training method of claim 9 wherein the pH-indicating means comprise a select pH indicator, the select pH indicator being selected from the group consisting of a methyl red pH indicator, a universal pH indicator and a litmus pH indicator.

14. The toilet training method of claim 9 wherein the target device is formed to comprise an ornamental marking, the ornamental marking being applied to an upper surface of the upper layer for visually attracting the urine stream provider.

15. A urine stream target device manufacturing method, the method comprising the steps of:

soaking an absorbent first material in pH-indicating means thr indicating pH, the step of soaking the absorbent first material in pH-indicating means comprising the steps of:

pre-soaking the absorbent first material in an alkaline solution;

drying the pre-soaked absorbent first material; and re-soaking the absorbent first material in a select pH indicator solution;

re-drying the re-soaked absorbent first material;

adhesively applying a non-absorbent second material to the absorbent first material thereby forming a multilayer arrangement; and pressing a portion of the multilayer arrangement to finally form a urine stream target device.

16. The manufacturing method of claim 15 comprising the step of ornamentally marking an upper surface of the first absorbent material with an ornamental marking, the ornamental marking comprising a second color different than the first color.

17. The manufacturing method of claim 16 wherein the ornamental marking comprises a select ink, the select ink for preventing inadvertent color change of the first color.

18. A multi-layer urine stream target device usable as a toilet training aid, the target device comprising:

an upper layer of a first material, a lower layer of a second material attached to the upper layer, a rounded transverse cross-section, an angled upper section defining a first diameter and a second diameter, and pH-indicating means for indicating pH, the first diameter defining a junction site intermediate a planar lower section and the angled upper section, an upper rim of the angled upper section defining the second diameter, the second diameter being greater in magnitude than the first diameter, the pH-indicating means being absorbed by the first material thereby providing the first material with a first color, the upper layer being floatable upon a water surface via the lower layer, the pH-indicating means causing a color change in the first material when urine comes into contact therewith, the color change for aiding in toilet training a urine stream provider.

19. A toilet training method, the toilet training method comprising the steps of:

providing a urine stream target device, the urine stream target device comprising:

an upper layer of a first material;

a lower layer of a second material attached to the upper layer;

pH-indicating means for indicating pH; and an alkaline compound; the pH-indicating means and alkaline compound being absorbed by the first material, the upper layer thereby being provided with first coloration and for rendering the upper layer with a basic environment, the basic environment for enhancing color change characteristics of the target device;

floating the target device upon a water surface via the lower layer, thereby properly positioning the target device for a urine stream provider; and targeting the target device with a urine stream provided by the urine stream provider, the pH-indicating means causing a color change in the upper layer when urine comes into contact therewith, the color change for aiding in toilet training the urine stream provider.

* * * * *